United States Patent [19]

Olsen

[11] Patent Number: 4,726,872

[45] Date of Patent: Feb. 23, 1988

[54] PRIMARY-SECONDARY PAD SYSTEM

[75] Inventor: Robert F. Olsen, Toledo, Ohio

[73] Assignee: Owens-Illinois Glass Container Inc., Toledo, Ohio

[21] Appl. No.: 856,242

[22] Filed: Apr. 28, 1986

[51] Int. Cl.[4] ..... B65C 9/04; B65C 9/36

[52] U.S. Cl. ..... 156/455; 156/458; 156/493; 156/568; 156/DIG. 13; 156/DIG. 26; 156/DIG. 42

[58] Field of Search ..... 156/446, 450, 455, 458, 156/497, 521, 568, 578, 493, DIG. 13, DIG. 26, DIG. 33, DIG. 35, DIG. 41, DIG. 42

[56] References Cited

U.S. PATENT DOCUMENTS

| | | | |
|---|---|---|---|
| 1,078,723 | 11/1913 | Dodge | 156/455 |
| 3,140,214 | 7/1964 | Von Hofe | 156/448 |
| 4,338,155 | 7/1982 | Buchele | 156/567 |
| 4,500,386 | 2/1985 | Hoffman | 156/450 |
| 4,574,020 | 3/1986 | Fosnaught | 156/450 |

FOREIGN PATENT DOCUMENTS

| | | | |
|---|---|---|---|
| 1000066 | 8/1965 | United Kingdom | 156/DIG. 13 |

*Primary Examiner*—Michael Wityshyn

*Attorney, Agent, or Firm*—H. G. Bruss

[57] ABSTRACT

Apparatus for guiding bottles along the surface of a rotating vacuum drum which holds plastic shrink labels until an individual label is rolled about the circumference of the bottle to form an overlapped seam. The bottles are of the style that have tapering shoulder and rounded heel joined by a cylindrical side wall. The rotational orientation of the bottle and label is maintained during roll-on of the label from the drum by a primary roll-on pad and the bottle with the label thereon is passed to an generally linear, secondary roll-on pad with the sleeve label bearing bottle moved along the secondary pad by a horizontally driven, vertically oriented belt. The secondary pad at locations along its length is provided with resilient vertically extending, contoured pads which also extend outward beyond the surface of the secondary pads so as to contact the formed overlap seam of the label to press the seam against the underlying bottle. The resilient pads have a contour which is generally the same as the shape of the bottle including the heel and shoulder to assure that the seam will withstand the stress of heat shrinking of the label about the bottle heel and shoulder portions.

6 Claims, 5 Drawing Figures

PRIMARY-SECONDARY PAD SYSTEM

BACKGROUND OF THE INVENTION

Apparatus for wrapping labels onto bottles as they are moved in single line through a wrap machine is generally described in co-pending U.S. patent application Ser. No. 856,243 filed on 04/28/86. and U.S. patent application Ser. No. 856,564 filed on 04/28/86. Both of these applications are assigned to the assignee of the present application.

The present invention deals with the problem of assuring that the labels which have been wrapped completely around the bottles and have been adhered to themselves will have their overlapped ends completely glued together for the full height of the label so that a seam will be formed which will withstand the strain of the plastic label being circumferentially heat shrunk.

In order for the seam to be formed reliably at relative high speeds, on bottles that do not have sidewalls that are vertical throughout the label height, the present invention provides a bottle handling system where the primary roll-on pad and the transition to a secondary roll-on pad are carried out with the rotation of the bottle under positive control at all times.

Thus the bottle, when it arrives at the secondary roll-on pad, will be at a specific circumferential orientation such that contoured, side engaging pads on the secondary roll-on pads can be set to exert a compressive load on the overlap seam of the label throughout its full height and follow the bottle contour.

With the foregoing in view, it is an object of the present invention to provide a primary-secondary roll-on pad system for bottles with plastic labels with overlapped ends to be pressed in a vertical line corresponding to the vertical seam of the label, to insure that the leading and trailing ends of the wraparound labels will be firmly adhered to each other and capable of resisting the stress of being heat shrunk to the bottle shape. This is particularly true for round bottles whose silhouette is not vertical over the full height of the label such as a soft drink bottle with the label extending above the shoulder or below the heel are to the bearing surface of the bottle.

Other and further objects will be apparent from the following description taken in conjunction with the annexed sheets of drawings.

DETAILED DESCRIPTION OF THE DRAWINGS

Figure 1:
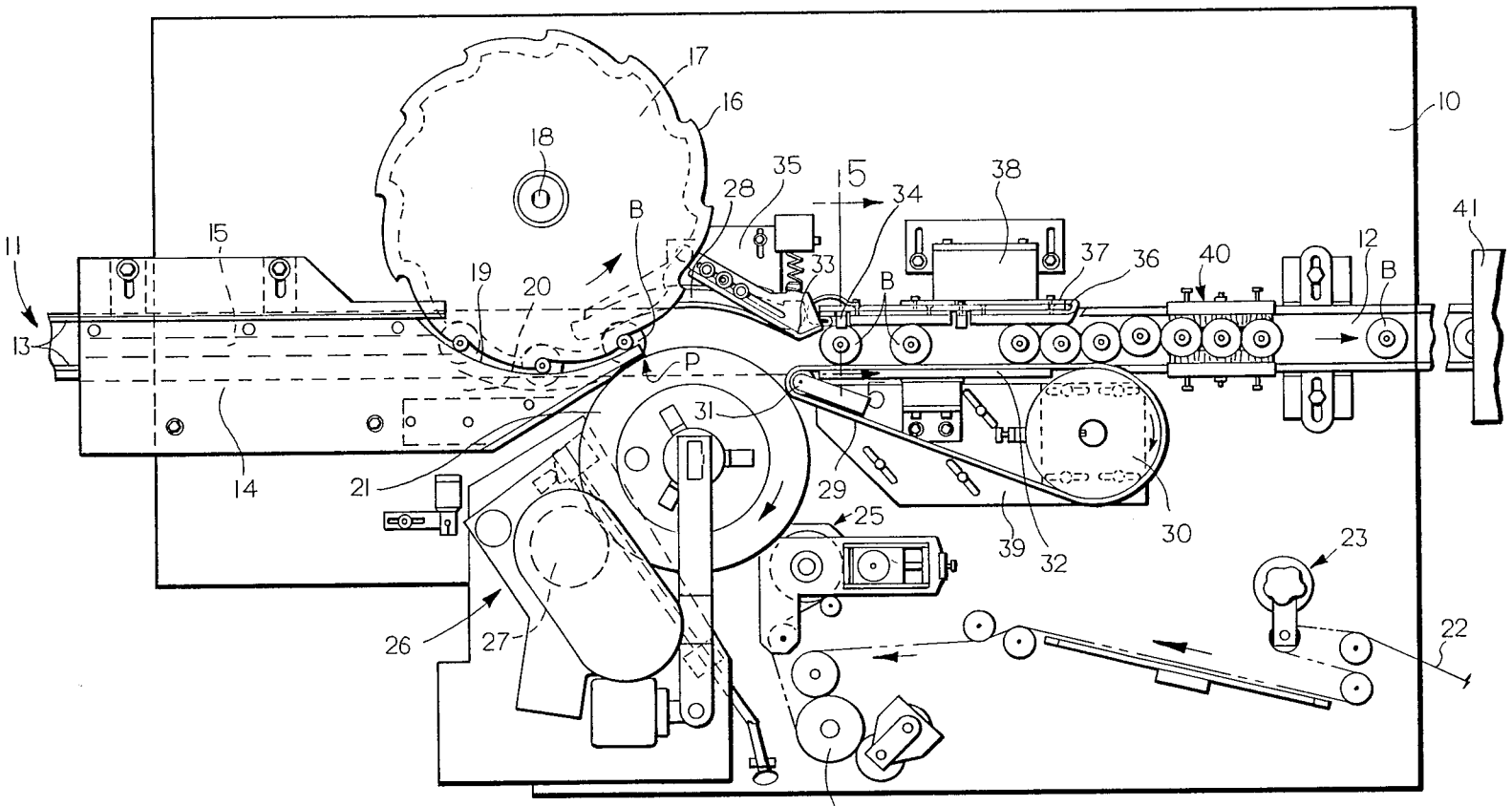
FIG. 1 is a plan view of a wrapped sleeve label machine for bottles incorporating the primary and secondary roll-on pads of the invention.

With particular réference to FIG. 1, the following is a general description of the operation of the overall labeling system. A horizontal supporting table 10 of generally rectangular configuration serves to support the mechanisms and is itself supported above the floor by a plurality of vertical legs (not shown). Mounted above the table and extending generally across the length of the table is a conveyor generally designated 11. The conveyor 11 has a horizontally moving upper surface 12 which is driven in the direction of the arrow shown thereon. Containers or bottles B to be labeled are supplied at the left hand end of the conveyor 11 in an upright attitude on the surface 12 of the conveyor. With the conveyor surface 12 moving in the direction of the arrow thereon, the bottles will be carried from the left to the right as viewed in FIG. 1. The bottles are guided by rails 13 which extend along either side of the conveyor 12. An overhead member 14 is shown which is provided in its under surface with a guiding slot 15 within which the finish or neck of the bottles will be guided. As can be seen when viewing FIG. 1, the bottles moving from the left approach a pair of vertically spaced, pocketed starwheels 16 and 17 which are both mounted to a vertical axle 18 which is rotated in a counterclockwise direction as viewed in FIG. 1. The starwheel 16 has 12 pockets circumferentially spaced about the circumference thereof, which pockets are adapted to engage the neck of the bottles being handled and the starwheel 17 is provided with a like number of pockets that are of somewhat larger dimension and are adapted to engage the sidewall of the bottles being handled.

An arcuate guide 19 has a contour which is coaxial with respect to the axle 18 and serves to hold the necks of the bottles at a precise distance from the axle 18 of the starwheel 16. In addition, there is a lower arcuate guide 20 which is mounted at a height generally the same as the height of the sidewall or body engaging starwheel 17 to maintain the bottles B with their axes vertical during the movement of the bottles by the starwheels 16 and 17. When a bottle reaches the position generally designated P, the side of the bottle B will approach, generally tangentially, the circumferential periphery of a vacuum drum 21. The vacuum drum 21 is a generally cylindrical member having a height somewhat greater than the height of a label which is to be applied to the bottles B. The drum 21 will have a plurality of vacuum passages opening through the surface thereof to, in effect, grip the individual labels supplied thereto and to convey the labels to the position P. The labels may be formed from a web 22 of foam-film polystyrene which may be pre-printed and which will be coming from a supply (not shown) at the right through a tension takeup device 23. After passing the tension compensating device 23 the web 22 will pass around a driven feed roller 24 and then to a label cutting and handling system generally designated 25. The label cutting device 25 cuts the label at a predetermined point in its length with the leading edge of the label being brought into peripheral engagement with the drum 21. The label will adhere to the outer surface of the drum 21 and move in the direction of the arrow on the drum 21 to carry the label past a glue or solvent applying station 26 where a glue roll or solvent transfer gravure roll 27 will apply the glue or solvent to selected, defined areas of the label. The gravure roll 27 is driven by a mechanism (not shown) generally in a counterclockwise direction, as viewed in FIG. 1, and timed to present the solvent to the leading and trailing edges of the label which is transported by the vacuum drum 21.

At the point P the leading edge of the label will engage the sidewall of the bottle B and the leading edge of the label will become adhered to the bottle. From this point on, the bottle will be held against the surface of the drum by a primary backup pad 28 which is mounted to the surface of the table 10 by a bracket 35. The backup pad 28 may be formed of a resilient foam material such as foam rubber so that it will effectively hold the bottle B against the surface of the drum and as the drum continues to rotate the bottle will be effectively rolled along the surface of the label carried on the surface of the vacuum drum 21.

As previously described, the label carried by the drum 21 will have a vertical, full height, line of solvent applied to the trailing edge thereof and the trailing edge of the label will overlap the leading edge and adhere thereto to form an overlap seam. The container with the label applied continues to be guided by the primary backup pad 28 until it reaches a secondary roll-on belt 29. The secondary roll-on belt 29 passes about a drive roll 30 which is driven in the direction of the arrow shown thereon. The belt 29 also passes about a relatively small diameter inlet roll 31. A stationary, vertical backup surface 32 maintains the belt 29 in a fairly straight path between the drive roll 30 and the inlet roll 31. The bottle B will have the label completely wrapped thereabout prior to the movement of the bottle into engagement with the secondary roll-on belt 29. The primary backup pad 28 has an area 33 which tends to maintain the bottle in contact with the vacuum drum 21 until such time as the bottle engages the secondary roll-on belt 29. This provides a positive drive for the bottle so that when the bottle passes to the secondary roll-on belt, it will be rotated while moved along by the moving surface of the belt 29. The moving belt drives the rolling bottle so that the overlap seam of the label will contact a resilient pressing pad 34 which is mounted beyond the primary pad 28 on a bracket 35 which in turn is mounted to the table 10 as previously described.

A secondary backup pad 36 is positioned in bottle engaging, diametrically opposed, position relative to the secondary roll-on belt 29. The pad 36 is also formed with a foam rubber or like resilient member mounted to a plate 37 which in turn is mounted by bracket 38 to the top of the table 10.

It perhaps should be pointed out also that the secondary roll-on belt 29 and its drive roll 30 and inlet roll 31 are both mounted on a mounting plate 39 which may be moved relative to the upper surface of the table 10, and thus be adjusted toward or away from the center line of the conveyor 12 to accommodate the mechanism for different size bottles. Likewise, the secondary backup pad 36 and the bracket 38 which supports it may be moved toward or away from the center line of the conveyor 12.

As can be seen when viewing FIG. 1, the bottles B, after passing between the secondary backup pad and the secondary roll-on belt, will be held back by the brush spacer, generally designated 40, and that the bottles are moved through the brush spacer 40 in surface-to-surface contact under the force created by the moving belt 29, until such time as the leading bottle clears the spacer 40, at which time the bottle is free to move at the speed of the conveyor 12 into a heat shrink oven 41. The bottles will leave the brush spacer at regular intervals depending upon the speed with which the label wrap machine is operating. It should be understood that the drum 21 and drive roll 30 are commonly driven.

Figure 2:
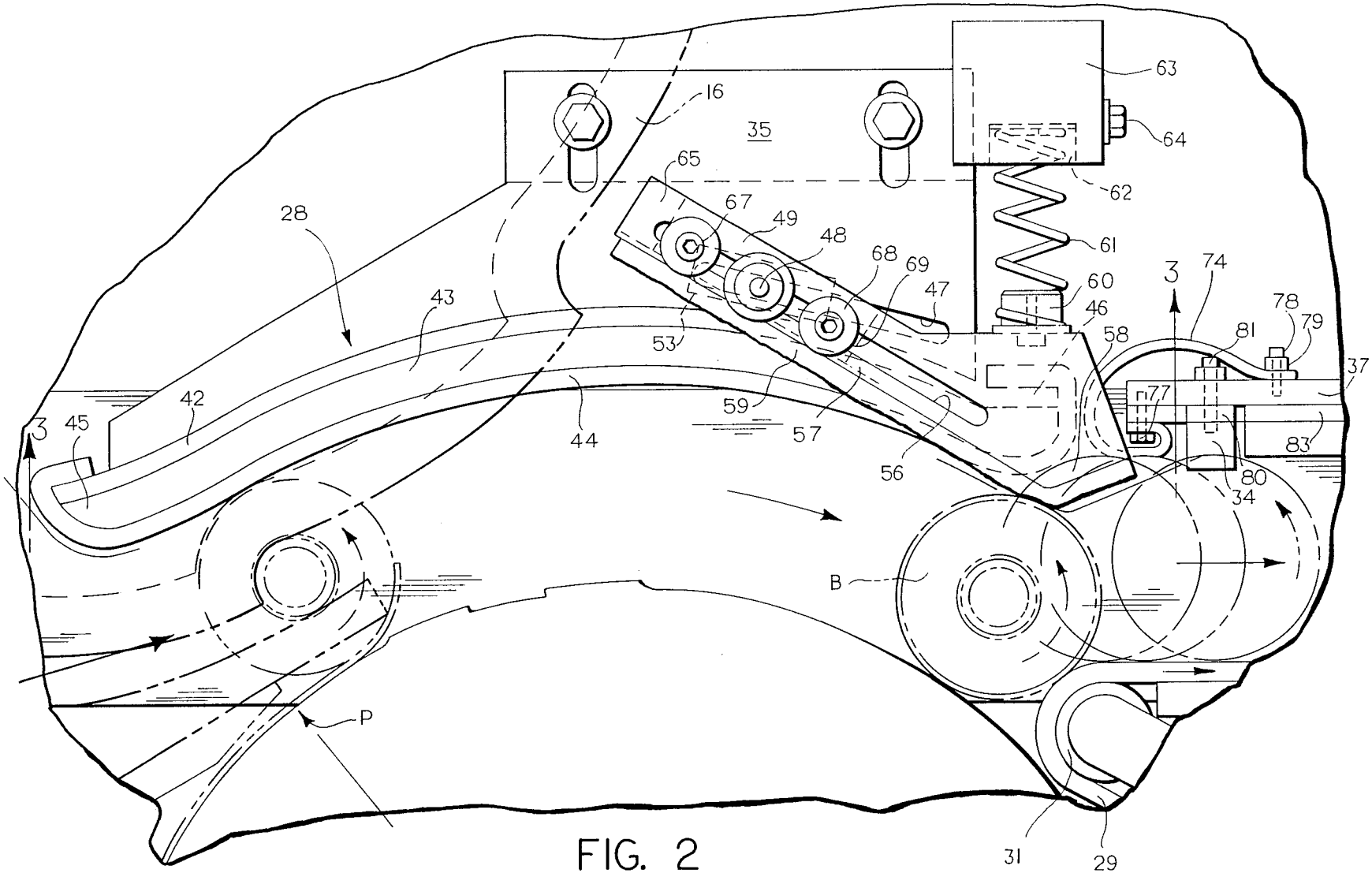
FIG. 2 is an enlarged plan view of the primary roll-on pad of FIG. 1.
Figure 3:
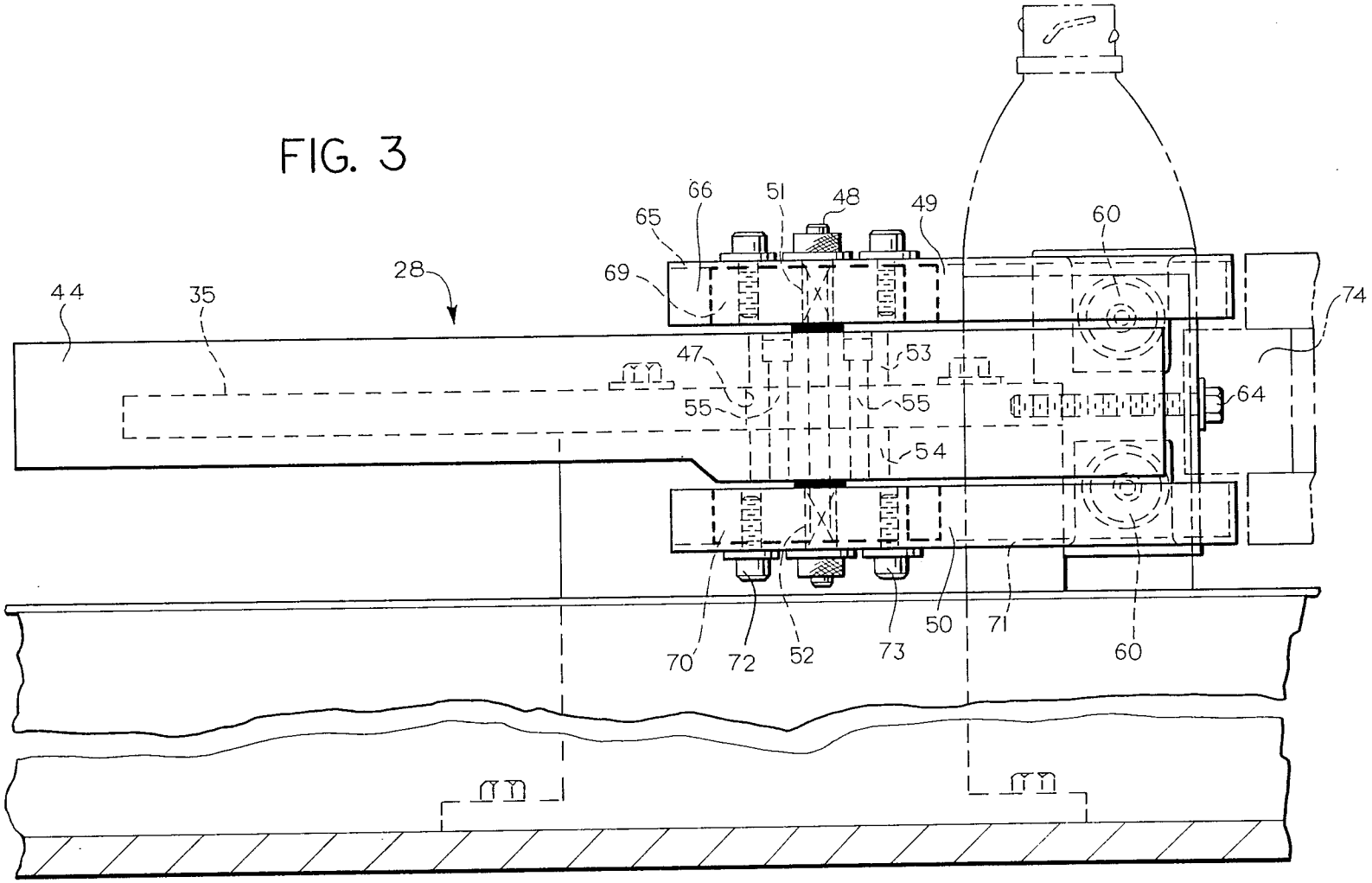
FIG. 3 is an elevational view of the primary roll-on pad of FIG. 2.

Turning now to FIGS. 2 and 3, the primary backup pad will be described in greater detail.

The pad 28 comprises a contoured, generally vertically positioned aluminum member 42. The member 42 is mounted to the forward edge of the bracket 35. The contour of the plate 42 is generally such that it describes an arc of a circle which will have the same axis as the central vertical axis of the drum 21 and faces the outer circumference of the drum as shown in FIGS. 1 and 2. The plate 42 is provided with a foam rubber facing 43 which may be glued to the surface thereof. The facing 43 is essentially of the same height as the plate 42. The foam rubber 43 in turn has a cover 44 of belting material with a high coefficient of friction. The belting material 44 may or may not have a smooth surface which is facing the drum 21. As can be seen in FIG. 2, the belting 44 extends about both ends of the plate 42 and may be adhered thereto and to the back of the plate 42 and to the surface of the foam rubber 43 by any suitable adhesive. The spacing of the face of the belting material 44 from the drum 21 is generally somewhat less than the diameter of the bottle which is to be rolled along the drum and along the surface of the belting material 44. As can be seen in FIG. 2, the forward end of the plate 42 and the overlying belting material is curved so that the bottles which will enter between the backup pad 28 and the drum 21 may enter without danger of being jammed. By the same token, the trailing end 46 of the backup pad 28 is also formed in a curve which the belting in effect follows and wraps around and becomes the trailing end of the pad 28. The backup 35 is provided with an elongated slot 47. A vertical pivot shaft 48 extends through the slot 47. The vertical shaft 48 is shiftable along the length of the elongated slot 47 for the purpose of providing adjustability of a pair of arms 49 and 50. The arm 49 is above the plate 42 and the other arm 50 is below the plate 42. The arms 49 and 50 are provided with bearings 51 and 52 which surround the shaft 48 upon which they are mounted for pivotal movement. A pair of spacer blocks 53 and 54 support the central portion of the vertical pivot shaft 48. The blocks 53 and 54 are bolted together by a pair of bolts 55, which extend through counterbored vertical openings in the block 53 and are threaded into the lower block 54. These bolts 55 also pass through the horizontal elongated slot 47 and by loosening the bolts 55 the blocks 53 and 54 may be moved along the length of the slot 47 in order to adjust the position of the pivot shaft 48. It should be understood that when the bolts 55 are tightened down, the position of the shaft 48 will be determined. Each of the arms 49 and 50 is provided with an elongated slot 56 extending therethrough which extends generally in the direction of the length of the arm. As can be seen in FIG. 2, the shaft 48 also extends through this slot 56. The arms 49 and 50 are basically made of metal, such as aluminum, and have a configuration as shown in FIG. 2 of a generally straight side joined at the trailing end of the arm by short angularly positioned end 58. Both the straight edge 57 and the angled end 58 are covered by a belting material similar to the belting material 44 of the pad 28. The belting 59 serves to grip the bottles and to maintain the orientation of a bottle which is precessing along the surface 44 of the pad 28 and, as will be explained later, will hold the bottle against the surface of the drum 21 and then the moving belt 29. Each of the arms 49 and 50 is provided with a generally round stud or abutment 60 attached to the rear side of the arm. The stub 60 serves as a centering guide for a helical compression spring 61. The rearward end of the compression spring 61 seats within a round cylindrical depression 62 formed in the face of a metal block 63. The block 63, which is an elongated block, has a pair of the cylindrical depressions 62 formed therein, each serving as the anchor for one end of the helical springs 61. The block 63 is fastened by a bolt 64 which threads into one edge of the plate 35.

The arms 50 and 49 may also be adjusted relative to the pivot shaft 48. The arms 49 and 50 actually are formed as a generally horizontal web 65 joined to a vertical web 66 and it is the web 66 to which the belting 59 is adhered. The upper arm 49 is adjustable relative to the pivot 48 by the loosening of a pair of socket head cap screws 67, 68 which are threaded into a block 69 positioned within the area between the horizontal web 65 and the vertical web 66. The block 69 has both the bolts 67 and 68 threaded therein and also serves as the support for the bearing 51 for the upper arm 49. The lower arm is similarly adjustable and supported, as the upper arm, by a block 70 which is adjustably bolted to a lower horizontal web portion 71 of the lower arm 50 by cap screws 72 and 73. Thus it can be seen that with the arrangement described, and as shown in FIG. 2, the bottle B traveling between the primary backup pad 28 and the drum 21 will be held against the surface of the drum until it arrives and comes in contact with the moving secondary roll-on belt 29. The shape of the arms 49 and 50 at the trailing end 58 assures that the bottles are positively held against the drum and that the bottles will be always in frictional contact with either the rotating drum or the moving belt 29. As can be seen in FIG. 2, when the bottle arrives at the position shown it will move and follow the path of the phantom line bottle movements shown in FIGS. 2 and 4. Thus it is understood that the spring biased arms 49 and 50 will maintain the bottle in contact with the drum 21 until such time as it comes under the influence and is driven by engagement with the moving belt 29. It is also important, as explained previously, that the orientation of the overlap seam which is formed by the label trailing edge overlapping the leading edge be maintained during the movement of the bottle through the label applying system.

Figure 4:
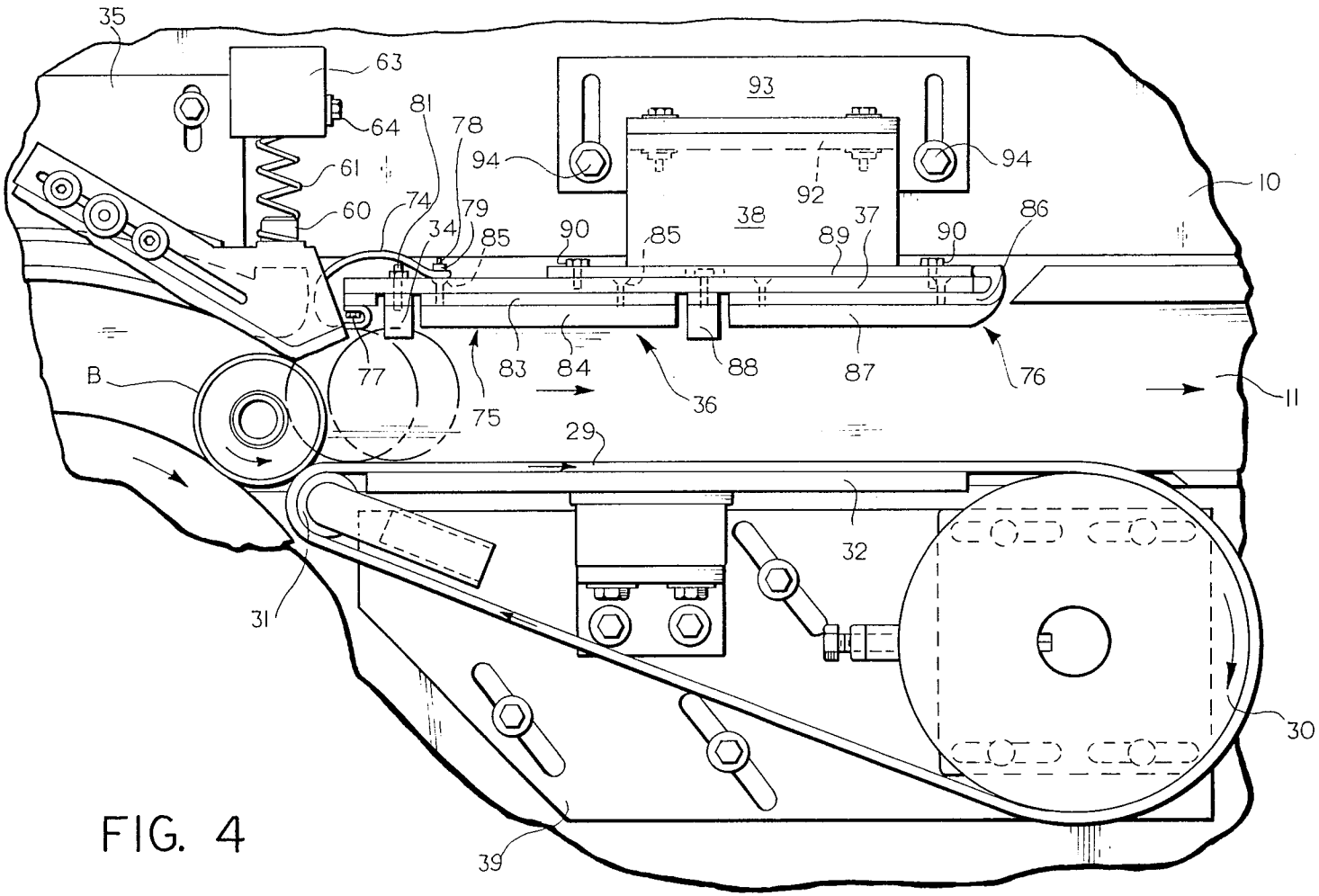
FIG. 4 is an enlarged plan view of the exit end of the primary roll-on pad and the secondary roll-on pad of FIG. 1; and, FIG. 5 is a cross-sectional view on an enlraged scale taken at line 5—5 of FIG. 1.
Figure 5:
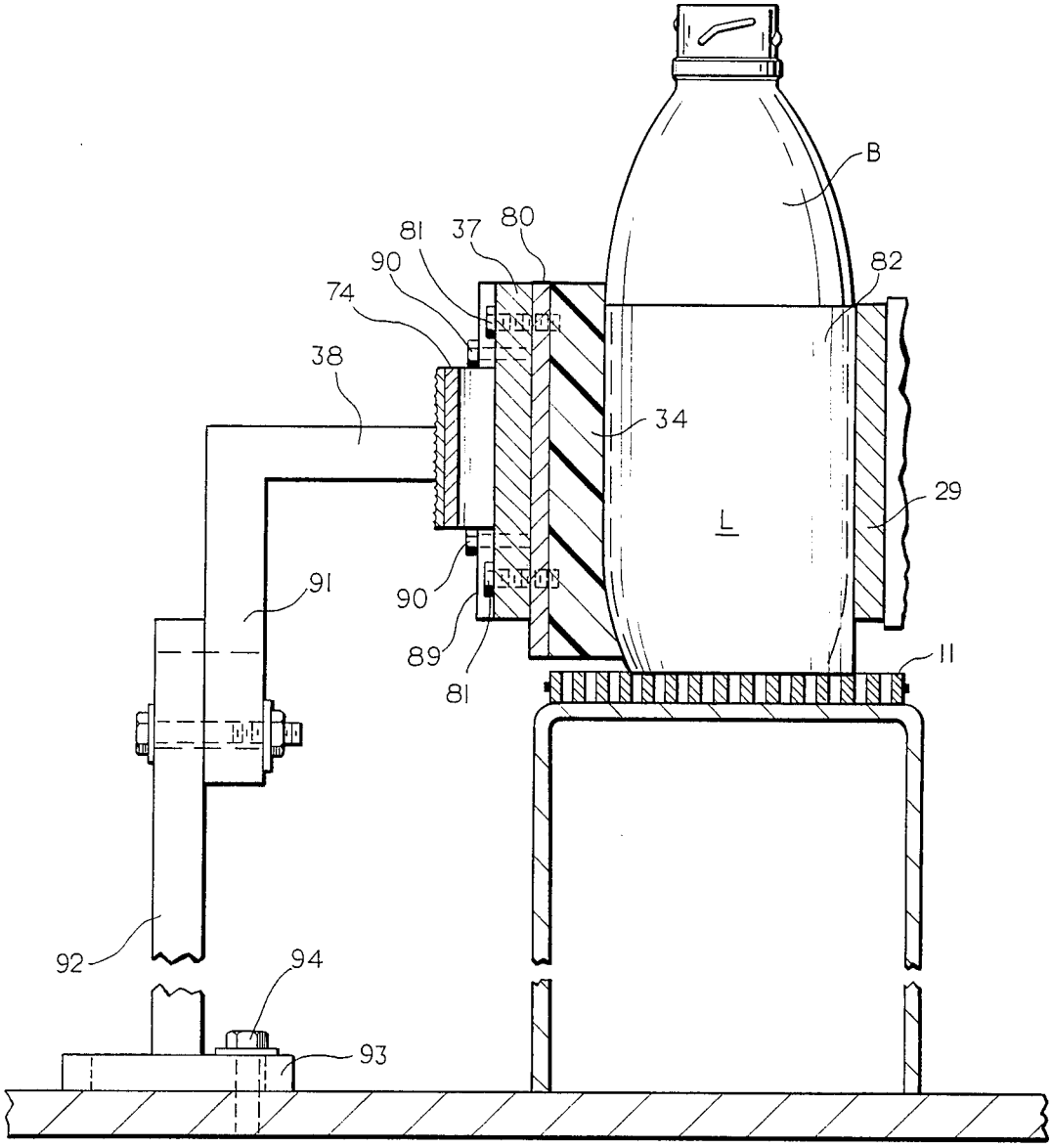

With particular reference to FIGS. 4 and 5, the detailed description of the secondary backup pad 36 will be given. The secondary backup pad 36 generally comprises a plate 37 to which all of the bottle facing elements to be described are mounted. The secondary backup pad consists of three bottle engaging pads in the form of a leading belt pad 74, a mid-pad 75 and a trailing pad 76. The leading belt pad 74 actually comprises a rubber belt which has a ruff-top surface which will engage the bottle. This belt 74 is anchored at one end to the end of the base 37 by a bolt 77. As can be seen in FIG. 2, the leading pad 74 extends from beneath the head of the bolt 77 and is curled back and overlies the head of the bolt 77 then curves back around the end of the base plate 37 to have its opposite end bolted to the back of the base plate by bolt 78. Actually, the bolt 78 passes through a plate 79 which serves to anchor the end of the belt pad 74. The pad 74 will have a height which is slightly less than the vertical spacing between the two arms 49 and 50, as schematically shown in FIG. 3. Thus it can be seen that the bottles become tightly held between the flexible rubber belt pad 74 and the secondary roll-on belt 29.

Immediately downstream from the leading belt pad the base plate 37 supports a first contour pad 34 which may be formed of a polyurethane foam which is adhered to an aluminum backing plate 80. The backing plate 80 is held to the base plate 37 by a pair of threaded bolts 81, as best shown in FIG. 5. As best seen in FIG. 5, the pad 34 is formed with a contour which follows the contour of the bottle B. The label 82 which is formed from the web 22 is of conventional material and preferably will be a plastic film-foam material with the film layer next to the bottle B and the foam layer being exposed exteriorly.

As previously explained, the film-foam label 82 will have its trailing end overlapping the leading end as it is wound onto the bottle from the vacuum drum 21 and it is this overlap area which must be fully sealed to form a complete vertical, tension resistant seam. In order to insure that the seam is completely formed and that the trailing edge is fully adhered to the leading edge of the label, the orientation of the bottle must be maintained during its travel through the applicating machine and to this position of the contour pad 34. The position of the overlap area is known and, as long as the bottle does not slip, it will approach and be engaged by the pad 34. The pad 34 is quite resilient and will clear the top of the conveyor by about 1/16" and will correspond to the height of the label 82. Thus the seam will be pressed tightly against the side of the bottle due to the fact that the bottle is pressed between the belt 29 and the pad 34. The belt 29, which is backed by the stationary plate 32, will generally follow a horizontal path with its vertical surface engaging the side of the labeled container B and will hold the bottle without slippage against the entire secondary backup pad 36.

The mid-pad 75 of the backup pad 36 comprises an elongated, relatively thin, metal plate 83 to which a foam rubber facing 84 is adhered. The plate 83 with the foam rubber facing thereon will have a height substantially less than the height of the polyurethane foam pad 34. In the configuration shown in FIG. 5, the pad 34 may be approximately 4" in height and on the same scale the plate 83 with its foam rubber facing 84 would be approximately 2" in height and located about midway of the height or below the mid-height of the pad 34. The plate 83 is mounted to the front face of the base 37 by a plurality of counter sunk, flat headed screws 85 as shown in FIG. 4. The pad 76, which forms the trailing pad, is also mounted to the base 37 by counter sunk, flat headed screws 85. The pad 76 is also formed of a metal plate 86 having a foam rubber facing 87 adhered thereto in a manner similar to the facing 84 which is applied to the mid-pad 75. The trailing end of the pad 76 is somewhat curved rearwardly to avoid providing any sharp edge or end to engage the foam label. However, the bottles as can be seen, will be pressed against the foam rubber facing 84 of the pad 75 and facing 87 of the pad 76. Intermediate the length of the plate 37 and occupying a space between the mid-pad 75 and the trailing pad 76 is a second contoured, seam pressing pad 88. The pad 88 is substantially identical in construction to that of pad 34 and is positioned at the point in the movement of the bottle between the secondary rollup belt 29 and the secondary backup pad 36 such that the seam will again present itself and become compressed as previously described with respect to the pad 34. In this manner, it is certain that the seam will be completely compressed and the overlapping leading and trailing ends of the label 82 will be adequately sealed to each other so that, upon subsequent movement of the bottle and the label through the head shrink tunnel 41, the seam will not open.

The base plate 37 is supported in the position shown in FIGS. 4 and 5 by a mounting plate 89 which is bolted thereto by bolts 90. The plate 89 generally extends horizontally along the back of the mounting plate 37 and is provided with slots through which the bolts 90 extend so that the mounting plate or base plate 37 may be adjusted horizontally, as viewed in FIGS. 1 and 4. Furthermore, in order to accommodate the function and operation of the apparatus when used for different size or diameter ware, the bracket 38 has a vertically downwardly extending plate portion 91 which is bolted to an upstanding plate 92. The plate 92 is formed integral with a horizontal base portion 93. The base portion or member 93 is bolted to the upper surface of the supporting table 10 by bolts 94 which extend through horizontal slots formed in the base member 93. In this manner it can be seen that the secondary backup pad 36 may be shifted horizontally toward and away from the moving belt 29 to accommodate the apparatus for different size or diameter of ware. It should also be understood that in order to make the accommodation it is generally necessary to change the specific secondary backup plate 36 shown, with different spacing of the contour pads 34 and 88, so as to press or compress the seams of the labels as the bottles move in the direction of the arrows shown on the conveyor 11 in FIG. 4.

From the foregoing, it can be seen that an apparatus is provided for rolling labels onto bottles and controlling the position of the overlapped seam of the rolled-on labels through a series of handling steps. So as to accurately orient the label seam, the seam will be pressed twice against a pair of vertical contour pads that are positioned along the outward path of movement of the bottles from the sleeve wrapping portion of the machine. This assures that the labels are completely sealed along their seams to assure their ability to be heat shrunk at a later stage in the operation of the apparatus and not have the seam open up.

As would be expected, it is important that the label conform to the external contour of the underlying bottle without wrinkles or distortion of the label. The labels are normally printed on the exposed side with identifying graphics and thus the printing is carefully performed to account for the shape of the bottle. While heat shrinking of the label provides the best means to conform the film-foam label to the bottle, it is important that the wrap-around label not open or split a seam during shrinkage. The present invention assures that the solvent sealing at the overlap will be successful each and every time.

Obvious modifications may be made without departing from the spirit and scope of the following claims.

What is claimed:

1. In apparatus for applying wrap-around labels to glass containers which are round in horizontal section but which have a non-cylindrical contour, in which the labels are transported on the surface of a cylindrical drum with the leading edge of the label being adhesively attached to the side of the bottle and the bottle being held by a primary guide against the drum and rolled along the label by rotation of the drum to completely wrap the label about the container with the trailing edge of the label overlapping the leading edge, and where the label wrapped container is moved away from the drum by a linearly moving side wall engaging belt; and the overlap seam is pressed over its entire height and the orientation of the overlap seam is maintained during movement of the wrapped bottle from engagement with the primary guide to a secondary guide which is parallel to the moving belt, the improvement in said secondary guide comprising a horizontal pad in parallel, spaced relation to said belt, said pad having a planar surface adapted to hold the container against the moving belt, a first vertical seam pressing member having a profile that matches the contour of the container side wall, said member being located at the forward end of said secondary guide and extending beyond the planar surface of the horizontal pad to thereby press the overlap seam of the label to assure a complete vertical seam.

2. The apparatus of claim 1 further including a second vertical, pressing member having a profile essentially the same as the first member, means mounting said second member at the trailing end of said secondary guide to thereby effect a second pressing of the overlap seam of said label.

3. The apparatus of claim 2 wherein each said pressing member comprises a mounting plate supporting a foamed plastic member having the profile of the container side wall.

4. The apparatus of claim 1 further including a resilient pad carried by said secondary guide at its forward end to provide a positive control over the rotation of the bottle as it moves into contact with said first pressing member.

5. The apparatus of claim 1 or 4 wherein said pressing member comprises a mounting plate supporting a foamed plastic member having the profile of the container side wall.

6. The apparatus of claim 5 where the foamed plastic member is formed of a urethane.

* * * * *